United States Patent [19]

McDonald

[11] Patent Number: 4,647,018

[45] Date of Patent: Mar. 3, 1987

[54] APPARATUS FOR DEGASSING MOLTEN METAL

[75] Inventor: Howard A. McDonald, Hendersonville, N.C.

[73] Assignee: Swiss Aluminium Ltd., Chippis, Switzerland

[21] Appl. No.: 833,172

[22] Filed: Feb. 26, 1986

[51] Int. Cl.[4] ..... F27B 1/16

[52] U.S. Cl. ..... 266/218; 266/265

[58] Field of Search ..... 266/218, 265

[56] References Cited

U.S. PATENT DOCUMENTS

| | | | |
|---|---|---|---|
| 4,177,066 | 12/1979 | Clumpner | 266/218 |
| 4,392,636 | 7/1983 | Clumpner | 266/218 |
| 4,494,735 | 1/1985 | Hershey | 266/218 |

*Primary Examiner*—Peter D. Rosenberg

*Attorney, Agent, or Firm*—Bachman & LaPointe

[57] ABSTRACT

A gas nozzle design for use in a swirling tank reactor used in the degassing of molten metal with a fluxing gas. The nozzle design eliminates metal leakage from the reactor around the nozzle tip and gas leakage within the fluxing gas delivery line.

6 Claims, 4 Drawing Figures

APPARATUS FOR DEGASSING MOLTEN METAL

BACKGROUND OF THE INVENTION

The present invention is drawn to an improved gas injection nozzle design for use in a swirling tank reactor used in the degassing of molten metal with a fluxing gas.

An improved method and apparatus for degassing molten metal is disclosed in U.S. Pat. No. 4,177,066 to Joseph A. Clumpner and assigned to the assignee of the instant invention. The disclosure in the aforenoted patent teaches degassing molten metal using an apparatus comprising a swirling tank reactor wherein molten metal is tangentially introduced into the reactor so that the molten metal flows in a swirling rotating fashion as the metal passes from the inlet of the reactor to the outlet thereof. In order to achieve the desired swirling flow of molten metal from the metal inlet to the metal outlet of the reactor, it is required that the metal inlet be positioned with respect to the chamber wall of the reactor in such a manner as to tangentially introduce the liquid into the reactor. In a preferred embodiment, the swirling tank reactor comprises a first elongated substantially cylindrical sidewall portion and a second downwardly converging sidewall portion beneath the first substantially cylindrical wall portion. Fluxing gas inlet nozzles penetrate the converging wall portion at different heights thereof so as to optimize fluxing gas bubble dispersion through the entire melt as it passes from the inlet of the reactor to the outlet thereof. By positioning the nozzles at different heights in the converging wall portion, the fluxing gas nozzles are in turn located at various distances from the center axis of the swirling tank reactor thereby maximizing fluxing gas bubble dispersion. The specific details of the various embodiments of swirling tank reactors and nozzle locations disclosed in U.S. Pat. No. 4,177,066 may readily employ the improved gas injection nozzle design of the present invention and the disclosure of U.S. Pat. No. 4,177,066 is incorporated hereby by reference.

While the above-noted swirling tank reactors disclosed in U.S. Pat. No. 4,177,066 are superior to other known prior art inline degassing apparatuses, a number of problems have been encountered with fluxing gas nozzle designs. In particular, metal leakage from the reactor around the nozzle tip has been experienced. In addition, a problem has been encountered with leakage in the fluxing gas delivery line itself. Finally, it has been found that the nozzles tend to break off when they project through the chamber wall and into the tank proper.

U.S. Pat. No. 4,392,636 to Joseph A. Clumpner, assigned to the assignee of the instant invention, discloses a gas injection nozzle for use in the swirling tank reactor disclosed in U.S. Pat. No. 4,177,066. The gas nozzle design comprises a nozzle insert secured in the wall of the swirling tank reactor and flush with the inner circumference of said wall. The nozzle insert is provided with a seating surface adapted to receive a nozzle tip cone made of a ceramic material or the like. The fluxing gas nozzle is spring biased against the nozzle tip cone with adequate force to seal the nozzle against the tip cone and the tip cone against the nozzle insert so as to prevent metal leakage from the reactor around the fluxing gas nozzle. The fluxing gas nozzle is secured to the fluxing gas supply line by means of a nozzle screw assembly employing a seal between the nozzle screw assembly and the fluxing gas nozzle. It has been found that the rotational movement of the nozzle screw assembly on the seal between the nozzle screw assembly and the fluxing gas nozzle is detrimental to effective sealing. As the swirling tank reactor is designed for the removal of hydrogen and alkaline earth metals from molten aluminum and employs active gases such as chlorine and the like it is imperative that a leak-proof design for delivering the fluxing gas be developed.

U.S. Pat. No. 4,494,735 to Robert E. Hershey, assigned to the assignee of the instant invention, discloses a gas injection nozzle for use in a swirling tank reactor of the type described above. The gas nozzle design comprises a nozzle insert secured in the wall of the swirling tank reactor and flush with the inner circumference of the wall. The nozzle insert is provided with a seating surface adapted to receive a nozzle tip cone made of a ceramic material or the like. The fluxing gas nozzle is biased against the nozzle tip cone with adequate force to seal the nozzle against the tip cone so as to prevent metal leakage from the reactor around the fluxing gas nozzle. The fluxing gas nozzle is secured to the fluxing gas supply line by means of a nozzle screw assembly which comprises a nozzle nut which receives the nozzle blank. The nozzle nut receives in a non-rotational manner a clamp plate which presses against a seal provided between the clamp plate and the rear of the nozzle blank. A male screw member is threadably received in the nozzle nut and biases the clamp plate against the seal and correspondingly the nozzle blank to effect a leak-free seal. A spring washer may be provided between the clamp plate and the male screw to aid in biasing the clamp plate. While the nozzle assembly of the '735 patent initially operated without any leakage problem, over time leakage has occurred due to destruction of tip cone gasket materials.

Accordingly, it is a primary object of the present invention to provide an improved gas injection nozzle design for delivering a gaseous material which is free of leakage in the gas delivery line.

It is the principal object of the present invention to provide an improved gas injection nozzle design for use in a swirling tank reactor used in the degassing of molten metal with a fluxing gas.

It is a particular object of the present invention to provide an improved gas injection nozzle design for use in a swirling tank reactor used in the degassing of molten metal wherein gas leakage around the nozzle tip is eliminated.

It is a still a further object of the present invention to provide an improved gas injection nozzle design provided with the improvements as aforesaid which is convenient and inexpensive to utilize.

Further objects and advantages of the present invention will appear hereinbelow.

SUMMARY OF THE INVENTION

In accordance with the present invention the foregoing objects and advantages are readily obtained.

The present invention comprises an improved gas injection nozzle design for use in a swirling tank reactor used in the degassing of molten metal with a fluxing gas. The fluxing gas nozzle design comprises a hollow nozzle seat having a first tapered bore and a second tapered bore connected by a shoulder portion, a hollow nozzle tip cone sealingly positioned within said second tapered bore to form a primary seal, a nozzle tip gasket mounted in said first tapered bore and abutting said shoulder portion of said hollow nozzle seat to form a secondary seal therewith, a hollow shouldered nozzle tip having a cylindrical shoulder portion and a tapered tip portion positioned within said hollow nozzle seat such that said tapered tip portion is received in said hollow nozzle tip cone and said shoulder portion abuts said nozzle tip gasket for sandwiching said gasket between said shoulder portion of said nozzle tip and said nozzle seat, gas tube means secured to said nozzle tip for feeding gas thereto and insulation means surrounding said tube for insulating said tube within said hollow nozzle seat.

In accordance with a preferred embodiment of the present invention a plate and spacer tube are provided around the gas tube for holding the insulation in place around the tube. The insulation comprises a first and a second ceramic fiber wrap.

The apparatus of the present invention eliminates metal leakage from the reactor around the nozzle tip, prevents gas leakage in the fluxing gas delivery line and allows for easy replacement of the nozzle in the event of clogging.

DETAILED DESCRIPTION

Figure 1:
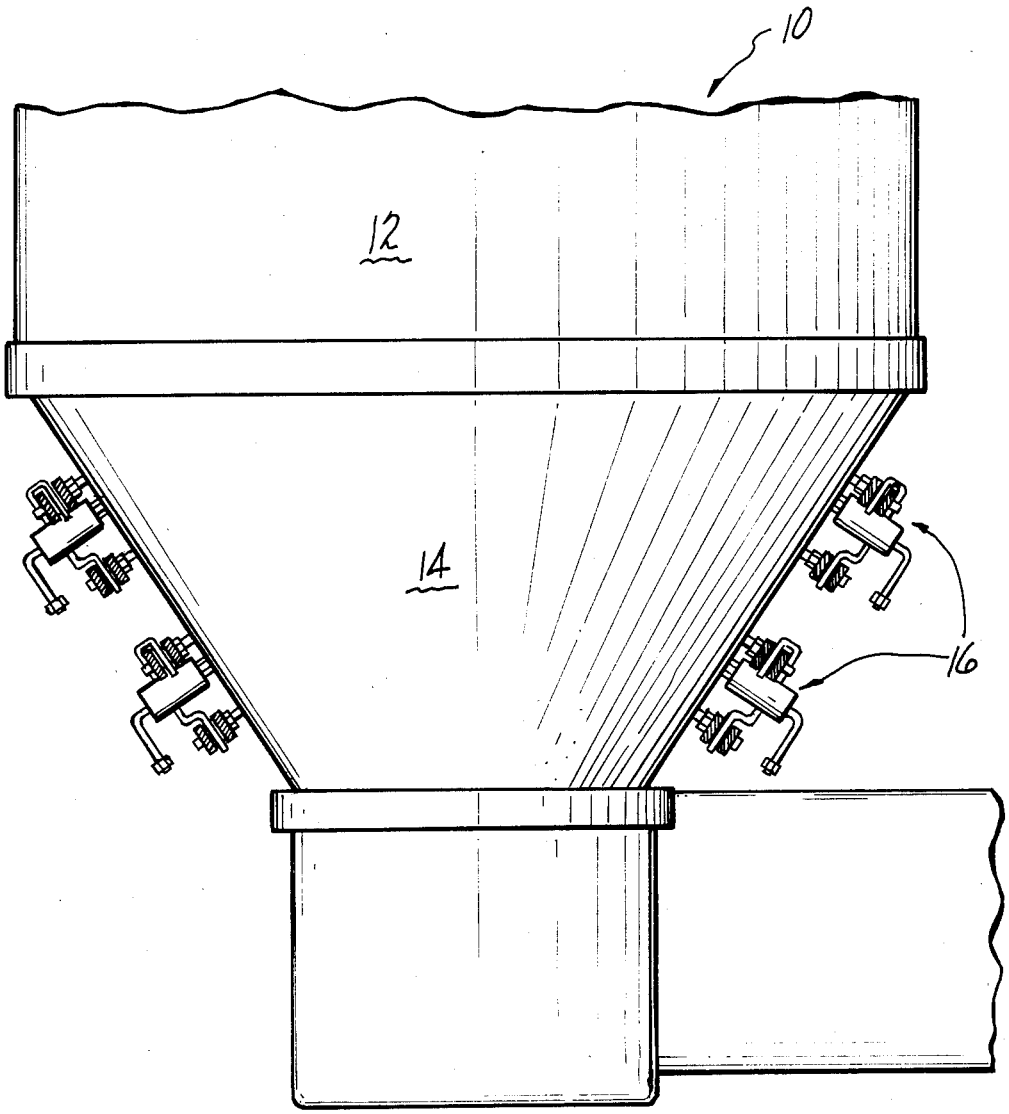
FIG. 1 is a schematic view of a preferred embodiment of a swirling tank reactor as disclosed in U.S. Pat. No. 4,177,066 employing the improved gas injection nozzle design of the present invention.

Referring to FIG. 1, the fluxing gas nozzle design is illustrated in location in a preferred embodiment of a swirling tank reactor 10 comprising a first substantially cylindrical sidewall portion 12 and a second downwardly converging sidewall portion 14 beneath cylindrical sidewall portion 12. As previously noted, the fluxing gas nozzle design of the present invention may be incorporated for use with any of the swirling tank reactors disclosed in U.S. Pat. No. 4,177,066 and the particular details of the designs of said swirling tank reactors are incorporated herein by reference.

Figure 2:
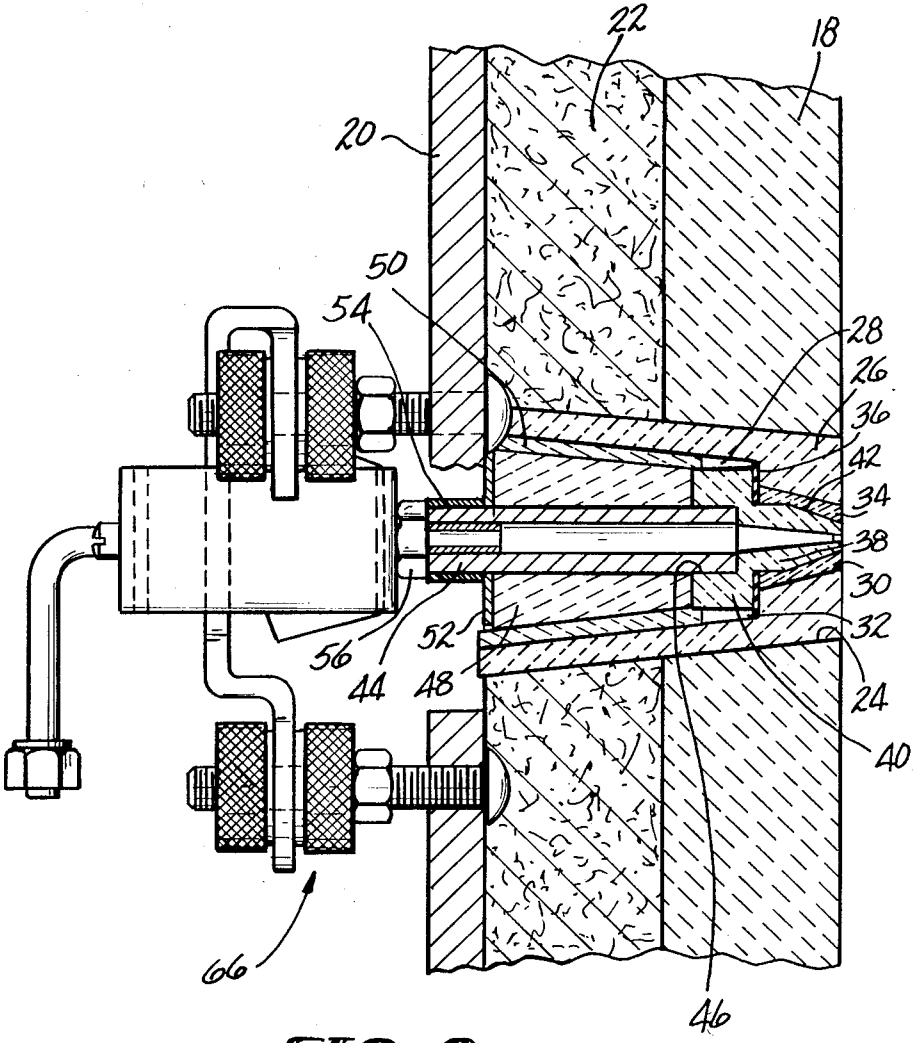
FIG. 2 is a schematic sectional view of the gas injection nozzle design of the present invention taken along line 2—2 of FIG. 3.
Figure 3:
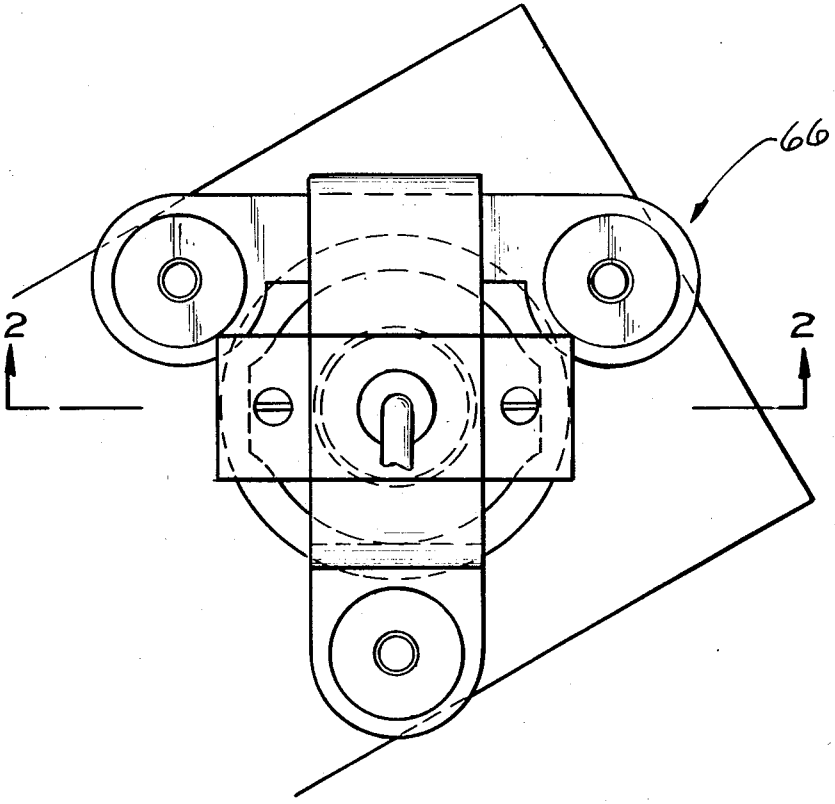
FIG. 3 is a front view of the gas injection nozzle mounting device secured to the body of the swirling tank reactor.
Figure 4:
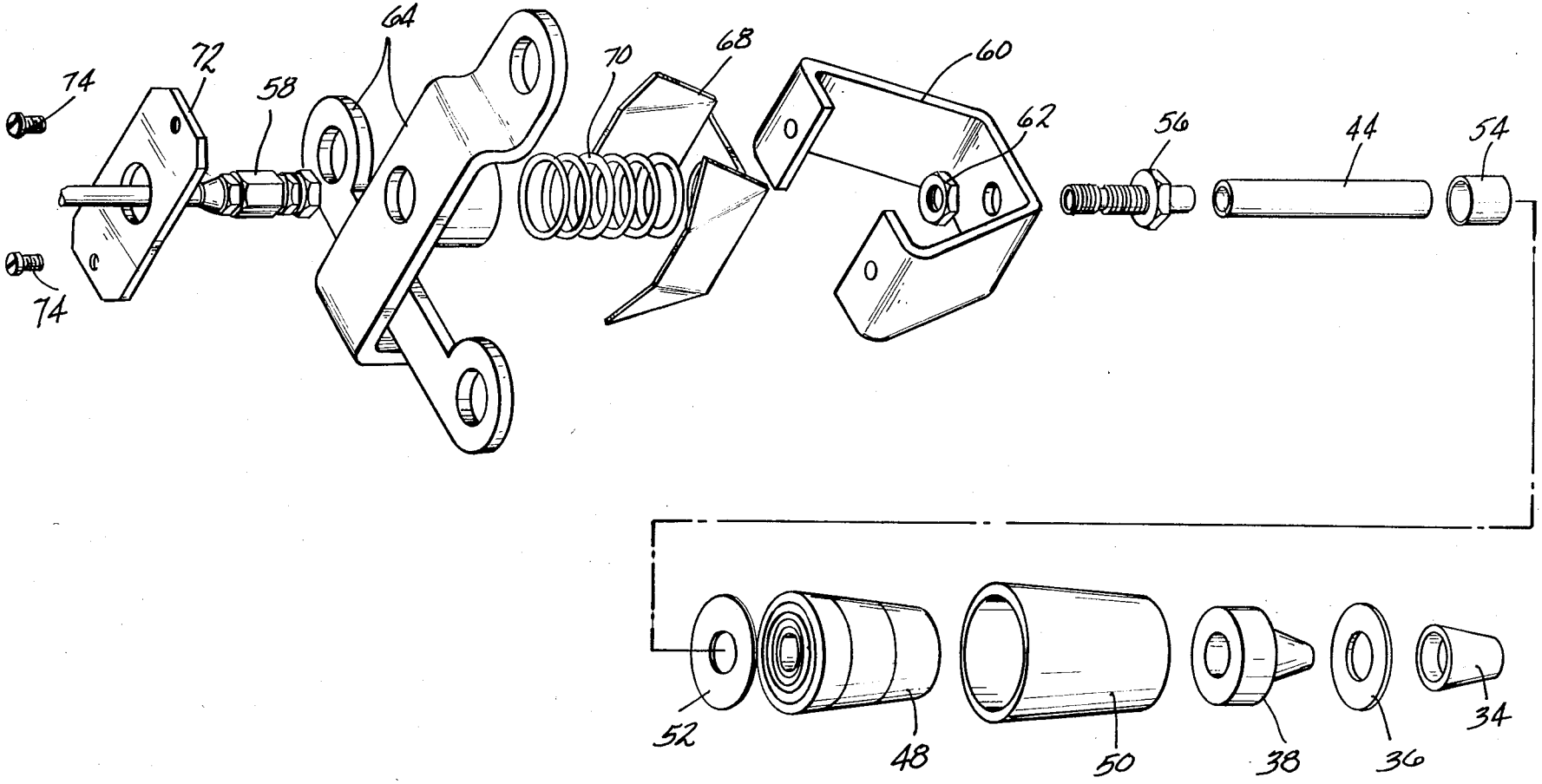
FIG. 4 is an exploded perspective view of the components of the gas injection nozzle design in accordance with the present invention.

A plurality of gas injection nozzle assemblies are secured in the converging wall portion 14 by means of mounting frame 16. With particular reference to FIGS. 2–4, the details of the gas injection nozzle design and mounting frame will be described in detail.

With particular reference to FIG. 2 the converging sidewall portion 14 of the swirling tank reactor comprises a first inner wall 18 made of a suitable refractory material and a second outer wall 20, preferably made of steel, spaced from inner wall 18. A packing of insulation 22 is provided in the space provided between inner wall 18 and outer wall 20.

Inner wall 18 is provided with a plurality of port holes 24 which are adapted to receive the nozzle assembly of the present invention. Mounted in each of the port holes 24 is a hollow nozzle seat 26 having a first tapered bore 28 and a second tapered bore 30 connected by a shoulder portion 32. The shouldered hollow nozzle seat may be made of any suitable ceramic material.

A hollow nozzle tip cone 34 of suitable ceramic material is sealingly positioned within the second tapered bore 30 of hollow nozzle seat 26. A nozzle tip gasket 36 of suitable ceramic material lies on and seals against the shoulder 32 of hollow nozzle seat 26.

A hollow shouldered nozzle tip 38 having a cylindrical shoulder portion 40 and a tapered tip portion 42 is positioned within the hollow nozzle seat 26 such that the tapered tip portion 42 is received in the hollow nozzle tip cone 34 to form a primary sea1 against metal leakage and the shoulder portion 40 abuts the nozzle tip gasket 36 for sandwiching the gasket 36 between the shouldered portion 40 of the hollow shouldered nozzle tip 38 and the shouldered portion 32 of the nozzle seat 26 to form a secondary seal against metal leakage.

A gas tube 44 is secured in a recess 46 provided in hollow shouldered nozzle tip 38 by press fit, ceramic bonding or the like to form a gas tight connection. The tube 44 is surrounded by ceramic fiber insulation 48 and cone shaped fiber wrap 50 within hollow nozzle seat 26. The ceramic fiber insulation 48 is held in place by plate 52 which surrounds tube 44. The plate 52 is held in place on the tube by a spacer tube 54 which surrounds tube 44.

It is preferred that the cone shaped fiber wrap 50 be made of an intumescent sealing material which swells upon heating to form a tertiary seal against metal leakage. A suitable material is that sold under the Trademark SURESEAL ® which is a trademark of Consolidated Aluminum Corporation for an intumescent ceramic fiber material.

With reference particularly to FIG. 4, a connector 56 is bonded into tube 44 to be gas tight for connecting a gas hose 58 through which the fluxing gas is fed. A retaining bracket 60 is received over the connector 56 and secured thereto by a nut 62. The nozzle assembly is mounted in place on the reactor 10 by means of cross arm 64 which is bonded to the outer wall 20 of the reactor by means of nut and bolt assembly 66. The cross arm holds in place shield 68 and spring 70 which are secured to retaining bracket 60 via retaining plate 72 and screws 74.

It has been found that by employing the gas injection nozzle of the present invention metal and gas leakage is eliminated.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for use in the degassing of molten metal which comprises:

a chamber having an inner elongated sidewall portion, an outer elongated sidewall portion and a central axis;

metal inlet means positioned at a first height and tangentially located with respect to said chamber for tangentially introducing molten metal into said chamber such that said molten metal swirlingly flows from said molten metal inlet down through said chamber;

metal outlet means positioned at a second height below said first height for removing molten metal from said chamber; and at least one fluxing gas inlet means mounted in said first inner elongated sidewall portion below said first height for introducing fluxing gas into said chamber, said at least one fluxing gas inlet means comprises a nozzle assembly sealingly mounted within an opening provided in said first inner elongated sidewall portion wherein said nozzle assembly comprises a hollow nozzle seat having a first tapered bore and a second tapered bore connected by a shoulder portion, a hollow nozzle tip cone sealingly positioned within said second tapered bore, a nozzle tip gasket mounted in said first tapered bore and abutting said shoulder portion of said hollow nozzle seat forming a seal therewith, a hollow shouldered nozzle tip having a cylindrical shoulder portion and a tapered tip portion positioned within said hollow nozzle seat such that said tapered tip portion is received in said hollow nozzle tip cone and said shoulder portion abuts said nozzle tip gasket for sandwiching said gasket between said shoulder portion of said nozzle tip and said shoulder portion of said nozzle seat, gas tube means secured in a gas tight manner to said nozzle tip for feeding gas thereto and insulation means surrounding said tube for insulating said tube within said hollow nozzle seat.

2. An apparatus according to claim 1 wherein a plate and spacer tube are provided around said gas tube for holding said insulation means in place.

3. An apparatus according to claim 2 wherein said insulation means comprises a first and second ceramic fiber wrap.

4. A nozzle assembly comprising a hollow nozzle seat having a first tapered bore and a second tapered bore connected by a shoulder portion, a hollow nozzle tip cone sealingly positioned within said second tapered bore, a nozzle tip gasket mounted in said first tapered bore and abutting said shoulder portion of said hollow nozzle seat forming a seal therewith, a hollow shouldered nozzle tip having a cylindrical shoulder portion and a tapered tip portion positioned within said hollow nozzle seat such that said tapered tip portion is received in said hollow nozzle tip cone and said shoulder portion abuts said nozzle tip gasket for sandwiching said gasket between said shoulder portion of said nozzle tip and said shoulder portion of said nozzle seat, gas tube means secured in a gas tight manner to said nozzle tip for feeding gas thereto and insulation means surrounding said tube for insulating said tube within said hollow nozzle seat.

5. A nozzle assembly according to claim 4 wherein a plate and spacer tube are provided around said gas tube for holding said insulation means in place.

6. A nozzle assembly according to claim 5 wherein said insulation means comprises a first and second ceramic fiber wrap.

* * * * *